US009339671B1

(12) United States Patent
Raj et al.

(10) Patent No.: US 9,339,671 B1
(45) Date of Patent: May 17, 2016

(54) PORTABLE FIRE CONTAINMENT AND EXTINGUISHER SYSTEM FOR IN FLIGHT AIRCRAFT/CABIN FIRES CAUSED BY LITHIUM ION BATTERY FIRES OF PERSONAL ELECTRONIC DEVICES IN PASSENGER AIRCRAFT

(71) Applicants: Anthony Anand Raj, Bangalore (IN); Savitha Raj, Bangalore (IN); Samson Raj, Bangalore (IN)

(72) Inventors: Anthony Anand Raj, Bangalore (IN); Savitha Raj, Bangalore (IN); Samson Raj, Bangalore (IN)

( * ) Notice: Subject to any disclaimer, the term of this patent is extended or adjusted under 35 U.S.C. 154(b) by 0 days.

(21) Appl. No.: 14/576,177

(22) Filed: Dec. 18, 2014

(51) Int. Cl.

| | |
|---|---|
| ***A62C 35/58*** | (2006.01) |
| ***A62C 31/02*** | (2006.01) |
| ***A62C 3/00*** | (2006.01) |
| ***A62C 3/08*** | (2006.01) |
| ***A62C 13/64*** | (2006.01) |

(52) U.S. Cl.
CPC ... *A62C 3/00* (2013.01); *A62C 3/08* (2013.01); *A62C 13/64* (2013.01)

(58) Field of Classification Search
CPC ..... A62C 13/006; A62C 13/22; A62C 13/62; A62C 13/64; A62C 13/76; A62C 13/70
USPC ..... 169/30, 74, 85, 60
See application file for complete search history.

(56) References Cited

U.S. PATENT DOCUMENTS

| | | | | |
|---|---|---|---|---|
| 3,802,511 | A * | 4/1974 | Good, Jr. | B05B 9/0855 169/30 |
| 5,227,635 | A * | 7/1993 | Iwanczyk | G01T 1/241 250/336.1 |
| 2003/0062175 | A1* | 4/2003 | Olander | A62C 5/00 169/51 |
| 2008/0053667 | A1* | 3/2008 | Rousseau | A62C 13/70 169/51 |
| 2008/0289837 | A1* | 11/2008 | Rouosseau | A62C 13/003 169/88 |

* cited by examiner

*Primary Examiner* — Davis Hwu

(57) ABSTRACT

A fire suppression system usable in an aircraft cabin comprising a portable flight case with a dual shell, linings, valves, indicators, agency/industry-approved fire extinguishers and such. The case is able to be retrieved from storage for easy hand carriage in an aircraft/cabin for rapid deployment to any location inside it wherein a fire caused by batteries such as a Lithium Ion battery used in Personal Electronic Devices (PED) has erupted and to be able to enclose the PED fire inside the unit, and discharge into the unit, the fire extinguisher through ports such that the infused extinguishing medium would rapidly envelop the PED on fire inside the flight case while simultaneously allowing the egress of the initial smoke into containing flexible bags and equalizing the displaced volume being replaced by the extinguishing medium thus maintaining a pressurized environment, to chemically interact with and suppress the fire.

16 Claims, 5 Drawing Sheets

PORTABLE FIRE CONTAINMENT AND EXTINGUISHER SYSTEM FOR IN FLIGHT AIRCRAFT/CABIN FIRES CAUSED BY LITHIUM ION BATTERY FIRES OF PERSONAL ELECTRONIC DEVICES IN PASSENGER AIRCRAFT

FIELD OF THE INVENTION

The present invention relates to PED fire suppression systems. More particularly, the present invention relates to fire suppression systems caused by the failure of batteries used in Personal Electronic Devices, in the cabins of passenger aircraft.

SUMMARY OF THE INVENTION

The invention relates to a system such as a unit that is light-weight, portable & easy to use able to contain & extinguish a fire caused by the failure of batteries/Cells such as Lithium Ion Cells/Batteries either separately or when used in Personal Electronic Devices like Laptops, Mobile Phones, EBook Readers, Cameras, Recorders, Video Cameras/Lights, LED Torches, Electronic cigarettes, test equipment, hand power tools, etc.

It further comprises a portable high-temperature and corrosion resistant light-weight, quick heat dissipating metal hinged pressure vessel/case with a top and bottom shell, linings/coatings, rubber/elastomeric gaskets, O Rings, viewing windows, pre-set/variable constant pressure vent valves, bleed/purge/release valves, check/non-return valves, inlet ports, pressure presence indicators, interchangeable agency/industry compliant/approved fire extinguishers & extinguishing gases/agents, such as Halon and its derivatives, cylinders, mountings, clasps, locks, retainers, tubes, guides, shields, filters and such, wherein the unit is made in a suitable dimension similar to a flight case/bag affixed internally with a high-temperature and corrosion resistant rubber/elastomeric gaskets, a replaceable layer of flame resistant metallic film on a primary high-temperature and corrosion resistant chemically coated metallic layer to be retrieved from quick access storage for easy/rapid hand carriage by an adult in an aircraft/cabin that is in flight for rapid deployment to any location inside it wherein a fire has erupted caused by batteries such as a Lithium Ion battery used in PED's being carried in/on the same aircraft in flight and to be able to drop-in or enclose/encase and lockdown the PED on fire by physical means inside the unit and thereafter release/discharge into the unit, an agency/industry approved extinguishing gas/agent such as Halon and/or derivatives of the same by the operation of an rear mounted light weight quick release/removable agency/industry approved pressurized cylinder fire extinguisher through an high-temperature and corrosion resistant inlet port and check/non-return valve wherein the infused extinguishing agent/gas such as Halon and/or its derivatives would rapidly envelop the PED on Fire in a enclosing/blanketing manner inside the containment case/bag while simultaneously allowing the egress of the initial smoke in a controlled way by the automatic balancing operation of a high-temperature and corrosion resistant vent/purge valves so as to equalize the displaced volume being replaced by the extinguishing gas/agent therein maintaining a very small and constant pressurized and isolated micro environment to act upon the fire and chemically interact with the fire and suppress the progress of the fire.

The end result is that more so that of a Lithium Ion battery fire in thermal runaway which is characterised by self oxygen generation that rapidly accelerates into an hot corrosive liquid spraying explosive catastrophic fire in a relatively short time that cannot be easily contained/suppressed due to its self oxygen generating chemical contents, and inhibit/prevent its growth and thereby suppressing the fire, along with constantly and rapidly dissipating the build-up of internal heat by extraction with the said PED being in physical contact with the high-temperature and corrosion resistant light-weight, quick heat dissipating metal bag/case with its high-temperature and corrosion resistant evaporated/chemically coated primary metallic layer besides its replaceable flame/corrosion resistant secondary metallic layer that is very necessary to prevent a repeat/relapse of thermal runaway being a specific property of a Lithium Ion Battery fire wherein if further required enable quick release/removal/dismounting of the built in agency/industry approved light weight extinguisher cylinder from the case/bag without loss or depressurization of the pre-attained isolating gas/agent infused micro environment and to be able to further inject/infuse into the containment unit through the same inlet port & check valve, from a replacement or any nearby accessible, approved similar extinguisher cylinder without the need for mounting the same wherein furthermore the exterior of the case/bag could be subjected to the influence of a coolant liquid such as water being applied externally over the surface to enhance heat dissipation while containing the fire within allowing visual inspection by means of the viewing ports on the progress/suppression of the said fire wherein also be able to further manually inject/infuse through the same inlet port & check valve or a separate optional coolant inlet port non-return/check valve.*9b*, without loss of gas/agent infused micro environment pressure, any approved/allowed coolant liquid/agent such as water by means of any accessible plastic drinking water bottle so as to enable if require further quenching/dissipation of heat by envelopment of the PED on fire in addition to that of the already existing gas/agent attained micro environment while at any time allowing egress of gas/agent for constant pressure/displaced volume equalization by means of the self-balancing vent/purge valve to accommodate for added volume of gas/agent, coolant liquid, moreover in extreme cases, enable the subsequent & sequential coupling of multiple water bottles to the inlet port or a separate optional coolant inlet port while opening a bleed valve to allow continuous egress of coolant flow to the toilet/sink in the said aircraft to dissipate even larger amount of heat where after replacing the coolant further more by the reinfusion of fire extinguishing suppressor agent/gas thereby re-attaining a balanced volume/pressure micro environment and thereby maximize fire containment enabling prevention of thermal runaway and extinguishing of the PED on fire, further more allowing controlled discharge of pressure & gas/agent where upon operation of the bleed/purge valve wherein on visual inspection of a pressure presence/absence visual indicator and safe arrest by means of a pressure safety interlock the prevention of the lightly explosive release of the top cover in the eventuality of an accidental opening of the locking clasps without prior opening of the bleed/purge valve of the case/bag whereupon enable opening of the said case/bag for later Possible component or partial retrieval of PED enabling fault analysis/product safety improvement and/or any valuable data extraction from the said PED wherein all the time enabling safe containment, extinguishing & carriage besides in-flight safety of passenger/crew during transit of the aircraft and completion of flight and landing thereafter.

BACKGROUND OF THE INVENTION

Fire containment systems to control catastrophic and rapidly escalating fires occurring in/on an aircraft that is in flight, caused by the failure of batteries or cells either separately or when used in various portable/consumer PED's regularly carried by passengers or crew members, specifically such as those PED's made with Lithium Ion or Lithium Polymer technologies are known. These units are also known to be portable, light-weight, easily accessible/deployable besides being made of both metals and/or specialized flame proof fabrics are also known. However, they allow the progress of the fire without in-suite approved or otherwise, medium for arrest/suppression on/in the containment unit till final, full and complete destruction of the all the Cells of the Battery along with the all the materials, flammable, toxic, noxious or otherwise, of the PED on fire.

Fire control systems which are easily accessible and deployable such as portable/light weight Agency/Industry Approved extinguishers containing Halon or its derivatives fixed in and around the aircraft in flight are known. However, when operated in their prescribed operating form they are known to be effective only on generic open fires but insufficient or ineffective to control or fully extinguish an open fire of a PED containing a failed Lithium Ion battery and further, these systems do not effectively prevent a relapse/re-occurrence of the characteristic thermal run-away phenomenon. The currently prescribed open discharge of these hand held fire extinguishers in confined populated spaces such as the aircraft in flight are also known to cause passenger/crew discomfort similar to irritation of the eyes and dizziness in addition to that of the smoke/fumes emanating from the PED on fire. Further, the open and discharge of these extinguishers in the populated confines such as a cabin of an aircraft in flight can exacerbate medical conditions like allergies, asthma, respiratory distress and heart disease.

Fire control systems that are agency/industry approved and permanently affixed in and around the various sections/areas and remotely/automatically operated in the event of an occurrence of an on board fire, are also known. However, these types are normally fixed safety assets of the aircraft in flight being controlled by the management systems of the aircraft and are normally restricted to confined or unpopulated areas such as on-board cargo bays or flight management systems and thus cannot be disengaged and localized with in time of the lifetime of the fire and thus not usable. These types cannot be cost effectively or logically be installed in and around the required populated areas in and around the aircraft where a PED Fire is likely to occur without major and complex changes to the aircraft systems/logistics.

Fire control systems that are agency/industry approved which are autonomous with automatic release/dispersion capabilities and also being cost effective for large deployments in and around the passenger/crew areas of the aircraft in flight where a PED fire may occur are also known. However, these cannot be discharged and localized on the PED fire. Further, these systems have the same unpleasant attributes/effects similar to that of the already existing manually operated fire extinguishers when discharged in confined populated spaces.

Fire containment systems that are agency/industry approved, light weight, portable, easily deployable, cost effective made of metals with or without corrosion resistant, high temperature liners and/or flame proof high temperature fabrics with corrosion resistant capabilities besides allowing for addition of external coolants and the egress and containment of smoke/fumes of the PED on fire in an aircraft that is in flight are also known. However, they are designed to allow the progress of the fire without in-suite approved or otherwise, assets for arrest/suppression on/in the containment unit till final, full and complete destruction of all of the cells of the battery along with all of the materials, flammable, toxic, noxious or otherwise, of the PED on fire besides not allowing for the ability of later possible partial or retrieval of the PED or its components to enable future fault analysis/product safety improvement and/or any valuable data extraction from the PED simultaneously enabling safe containment, extinguishing & carriage besides in-flight safety of passenger/crew during transit of the aircraft and completion of flight and landing thereafter.

REPRESENTATION OF THE INVENTION

The object of the unit is to provide a portable fire containment & extinguisher system for use within the populated confines of an aircraft in flight, that is light-weight, easy to use, able to be deployed rapidly so as to localize and utilize in close proximity on a fire caused by failed/shorted/damaged batteries or cells in particular those constructed with Lithium Ion technology either separately or inside a PED whether operational or otherwise which is particularly oriented towards containing, arresting/suppression, control & subsequent extinguishing of the fire by the blanket envelopment and creation of a confined lightly pressurized micro environment rich with an agency/industry approved extinguishing gas such as Halon to chemically interact/influence the retardation of the fire within a purpose adapted corrosive resistant & heat dissipating, cost effective, hinged box-like flight case/bag. The unit should be capable of maximizing the prevention of the characteristic thermal runaway associated Lithium Ion batteries/cells and its oxygen/catalyst self-generated chemical contents and further escalation of the fire by additional/subsequent thermal runaway chain reaction failure of adjacent cells in the pack. The unit, due to the low deployment time available for suppression of the said fire, should further uniquely be capable to be in-suite mounted/adapted and used with various models of agency/industry approved low capacity mini fire extinguishers while also be rapidly dismounted, if required, accept infusion from any available standalone/dismounted hand operated fire extinguisher accessible onboard the aircraft in flight besides the further addition/infusion of approved coolants such as water for enhanced heat dissipation where heat dissipation is an added requisite for suppression of the Lithium Ion battery/cell fire. The unit should be capable of maintaining a prefixed low pressure rich with the extinguishing gas all the while allowing for the balance of displaced volume by gas or coolant liquid with the ability to be able to one way purge out the initial fire generated smoke by replacement of gas infusion and also disallow interaction of the fire within the containment unit and the surrounding free external air. The unit besides being cooled externally by application of water/coolant on its exterior should further be capable to manually be coupled if required in the extreme to a continuous coolant infusion by manual attachment of subsequent water bottles as a continuous heat exchanger while simultaneously allow egress of liquid to the outside such as the sink/toilet of the in-flight aircraft and be once again be infused thereafter with the extinguishing gas rich micro environment.

The unit and its various functional components should be resistant to flames and high temperature corrosive liquids that is characteristic of a Lithium Ion battery/cell fire and should have replacement/serviceable features to enable reuse. It is preferred that due to the unit being mildly pressurized that it should also have a pressure safety interlock mechanism to prevent accidental opening of the unit when under pressure besides having an visual indication of pressurised state to enable pressure release prior to opening of the unit. The unit should have the ability to contain, suppress and extinguish the Battery/PED fire with the minimum usage of gas and least discomfort and maximum safety to the crew/passengers during transit while also enabling its safe confined carriage towards the eventual possibility of later retrieval of the battery/cell or PED/valuable data for analysis or safety improvement/recovery respectively on landing of the aircraft.

This objective is achieved by a portable and light weight unit according to claim 1.

According to the invention, the unit is fabricated by means of a functionally repurposed commercially available flight case frequently used in the commercial/passenger aircraft industry made of a light-weight toughened aluminium alloy which has the size to weight and strength ratio to be able to able to at least house PED's of various dimensions/volumes such as from the least volume of a mobile phone or E-book to the largest laptop or a portable video/still camera or LED lights and be able to absorb dissipate heat rapidly to the exterior. It is preferred to apply a thin coating by chemical/vapour deposition of a different metal with a higher resistance to heat/flames and high-temperature corrosive liquids to the interior of the case. It is further preferred to apply a replaceable film of the similar metal as the coating over and above the first coating applied to the interior with an additional sandwiched third layer to increase thermal mass or enhance thermal absorption. Thereby the unit can be manufactured in a cost effective manner with the primary heat dissipation capability of the constructed metal along with the required flame, high-temperature and chemical resistance capabilities and also to be easily stored and rapidly retrieved for deployment from the standard available cabin baggage area or storage mounting of the aircraft interior.

Preferred embodiments of the invention are defined in the claims.

In particular it is preferred to use a flight case that is made as a dual shell hinged design made of aluminium alloy to achieve rapid heat absorption and dissipation of the Lithium Ion battery/cell fire from within the case. In particular is well known the characteristic thermal runaway property unique to it in that due to its chemical contents besides being flammable produces its own catalyst wherein if subdued by containing the heat even by envelopment with a substantial quantity of ice after a brief delay has a tendency to regenerate into a rapid and violent ensuing fire by causing the adjacent cells of the Lithium Ion battery to go into the similar thermal runaway condition. In the case of a single-cell PED, if thermal runaway is not prevented, the fire will consume the battery, however, this unit will still suppress the secondary fire caused by the burning of the PED and/or its components thereby preventing the release of toxic, noxious fumes and greatly increasing the probability of retrieval of data from the PED.

It is particularly preferred not to contain the heat generated within the unit by the fire but to absorb and dissipate the same rapidly to minimize progression of heat to the adjacent Lithium ion cell and avoid their imminent failure. It is further preferred to coat the interior of the case that is exposed to the fire with a chemical/vapour deposit metallic layer topped with a second replaceable similar metallic film with higher temperature and corrosion resistance capabilities due to the elevated temperatures attained by the fire and its highly corrosive liquid in a relatively short term which are beyond the temperature resistance versus require structural conditions of the aluminium alloy case. It is particularly preferred to have two separate layers of the second metal, one of them being thin and fixed while the other as a replaceable laminate to avoid puckering of the coated layer while maintaining anti corrosion properties when exposed to short duration intense flames. It is further preferred to laminate the replaceable second metallic layer over the first layer with high temperature adhesives so as to not only enable service/replacement of the same after first use but also allow for the possibility to insert/sandwich a third disposable or otherwise for example that of a high performance heat absorption material such as graphene besides metals and ceramics such as an absorption/conduction layer for enhanced thermal mass/performance as required.

The dual shell hinged design is preferred to allow for the ergonomic two hand operation/deployment of the unit being held open by and before the person as a protective safety body shield using two separate extra affixed handles while approaching the Lithium Ion battery/cell fire that is known to fume along with the ejection of corrosive and flaming liquids and to be able to encapsulate or engulf the same in a clam shell closure action or to be dropped into as required. In certain embodiments, the unit may be a self-contained, sealable unit, such as a bag, box, pouch, and its combinations thereof.

It is preferred to use standard fire extinguishers and extinguishing agents/gas with their preferred properties such as Halon and its derivatives that are commonly/effectively used for fire control in/on board aircraft and are already approved/certified by the aviation agency/industry to achieve overall cost effectiveness while also allowing for preferences of individual airframer/carriers' prequalified supply chain vendors/logistics. To this effect it is preferred to be designed with mounting adaptors/clamps to accommodate various cylinder models/brand and thus enable early adaptation primarily for the enhancement of passenger/crew/aviation Safety. It is further preferred to use a smaller dimensioned/light weight rapidly interchangeable fire extinguisher cylinder to be mounted on the unit so as to effectively reduce overall weight of the unit to enable its rapid hand carriage and ergonomic deployment by persons on board the aircraft together with the objective of weight reduction for aviation storage/carriage/usage. The lower volume extinguishing agent/gas is expected to be sufficiently effective due to its deployment in a confined micro environment that is localized on the fire. Also preferred is the rapid dismount and reattachment capabilities allowing for attachments of replacement cylinders together with the ability to affix and infuse/inject extinguishing agent/gas from any other accessible extinguisher cylinders on board the aircraft in flight while also allowing an approved coolant such as water to be infused/injected into the micro environment agent/gas rich containment unit thus enhancing the thermal mass for conduction/absorption.

It is preferred to use rubber/elastomeric parts with high thermal and anti-corrosion properties for all gaskets, bushings, O Rings and due to the flames/elevated temperatures and high temperature corrosive liquids being involved in the containment area during the occurrence and life of the Lithium Ion battery/cell fire besides stainless steel for functional components/parts as required. It is preferred to provide a non-return/check valve with a very low crack pressure that has the ability to allow both gases and liquids in only a singular direction so as to inward infuse/inject extinguishing agent/gas/coolant liquid and prevent its leakage back to the source or the exterior of the unit along with the provision of one or more, as backup failure safety, factory adjusted variable pressure, automatic release/purge valve set to a low release pressure and thereby be able to attain/maintain a low pressurized micro environment rich in extinguishing agent/gas to achieve localized and effective interaction with the fire. It is understood that additionally an optional independent and separate inlet port may also be incorporated for coolant infusion. It is also preferred to affix a bleed/relief/vent valve so as allow depressurization of the unit when required which would also enable the egress of built up heat if required and to maintain a running coolant flow from the interior of the unit to the exterior such as to the sink/toilet of the aircraft by itself or by a flexible/rigid coupling tube. It is also preferred to use the above-mentioned instruments to avoid periodic inspection of re-calibration of the unit.

It is preferred in particular to also provide a pressure driven interlocking retainer/locking clasp thereby achieving the functional requirement to prevent an accidental opening of the unit without prior depressurization together with a visual indication system to indicate pressurized state of the unit. In addition it is preferred to provide two or more visual viewing ports that are resistant to high temperatures to aid in evaluation of the progress/regression of the said fire inside the unit. In addition the unit in this embodiment may also be used for terrestrial use on the ground besides Aviation applications in the prescribed manner during research/lab testing/charging of Lithium technology batteries/cells or as safety equipment during carriage/use of such independent/standalone Lithium Ion batteries/cells or PED's/Mobile phones.

The factory adjusted variable pressure, automatic release/purge valve are coupled with high temperature resistant fume/smoke containment inflating bags/bellows, expanding bellows or light weight rolled-up air tight tubular bags either internally lined or made of high-temperature resistant/performance fabric or metallic foils to enable fume/vapor/smoke extraction and collection/containment during the operating phase and process of extinguishing the ensuing PED fire, the same being self-locking which could be, similar to a bloated/blown tubular balloon, there after dismounted/replaced once filled during the major fume releasing phase of the ensuing PED Fire to enable fume/vapor/smoke extraction and collection/containment during the operating phase and process of extinguishing the ensuing PED fire.

Further embodiments of the unit may include the application of thermally activated paint layers or stickers on the exterior of the flight case to show an increase or decrease of color intensity and patterns corresponding to the an increase or decrease of the PED fire within the unit. This embodiment provides visual cues to the temperature conditions of the fire inside the unit from the outside. This removes a need for future, periodic calibration of the unit.

Other Embodiments of the unit may be installed with a plurality of factory adjusted variable pressure, automatic release/purge valves and a plurality of bleed/relief/vent valve to suit larger battery capacities or faster venting rates.

In a further embodiment, it is understood that the unit could be attached, by coupling to the factory adjusted variable pressure, automatic release/purge valves 3*a*, 3*b*, 3*c*, 3*d*, either in-suite or to standalone mini battery operated portable compressors, with mini collection/storage cylinders to enable fume/vapor/smoke extraction and collection/containment during the operating phase and process of extinguishing the ensuing PED fire that could be dismounted thereafter.

It is also understood that as optional attachments and for enhanced performance during operation of the embodiment, it could be supplied with and placed on Fold out or Roll Out Metallic/High Thermal Performance Heat Absorption Mats to increase the Thermal Mass of the unit, if required by also pouring water or coolant on it, besides increasing the surface area of heat dissipation due the Mat being spread out and by its physical contact on it and therefore enable rapid extraction of heat generated within the unit for heat management/handling during the ensuing PED Fire.

BRIEF DESCRIPTION OF THE DRAWINGS

The invention will be explained in further detail in the following on the basis of exemplary examples with reference to the drawings, in which.

DETAILED DESCRIPTION OF DRAWINGS

Figure 1:
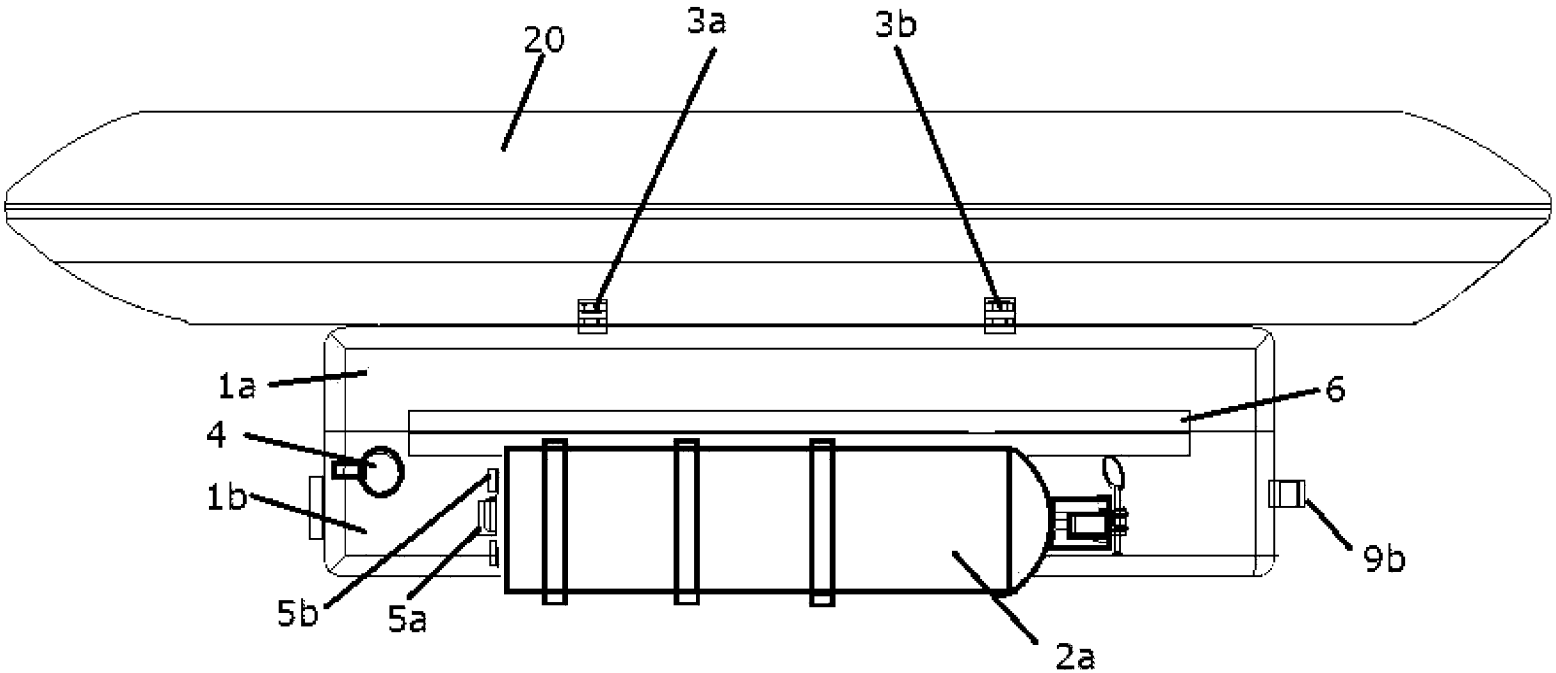
FIG. 1 shows a rear view of the unit with inflated fume containment bags according to the invention.

FIG. 1 shows a side view of the preferred embodiment of the unit constructed with a light-weight Aluminium flight case with its hinged 6, top 1*b* and bottom 2*b* shells. Such types of cases are commercially and easily available due to their popularity in the aircraft industry and are cost effective. The case dimensions chosen are nominally 22 inches wide 18 inches length and a depth of 6 inches suitable to encase the largest dimensioned popular consumer laptop and a depth of 6 inches to accommodate professional digital or video cameras with the largest height. It is understood the dimensions of the housing can be different depending on the regional/country requirements or current popularity of the PED's being carried by the crew/passengers on board the aircraft. It is also understood that the optional embodiment of the unit may be in the form of a multi metallic foil layer bag with similar attached approved extinguisher cylinders, valves and lip seals that could be rolled up for storage and unrolled during deployment. A different embodiment of the unit optionally may be made to be operable in a switchable mode where the in-suite approved extinguisher cylinder may be triggered for discharge externally onto the fire, when approaching the same during deployment, before or after opening the unit, for a short time/predetermined quantity and thereafter be manually/automatically changed to perform the hereafter described embodiment. The case is fitted with a high temperature rubber/elastomeric gasket 16 between the appropriately grooved mating surface of the top shell 1*b* and bottom shell 2*b* to enable a sealed and isolated enclosure. The unit is affixed with a pull handle band Top 13*a*, pull handle band bottom 13*b* besides a carrying handle 13*c* that enable ergonomic and versatile handling of the unit during deployment and for storage/retrieval.

The interior of the case is coated with a primary high temperature and corrosion resistant metallic layer 10, either by physical vapour deposition or chemical methods. A second high temperature and corrosion resistant replaceable metallic layer 11 is applied as a laminate. This layer, on first use, helps prevent the puckering/blistering of the thinner primary layer when it is being subjected to scorching flames. This layering further also allows the possibility to insert a third disposable or replaceable layer 12 which may be metallic or made of high performance materials to improve absorption or conduction and to enhance thermal mass and performance is made available by this arrangement during manufacture.

The enclosure is affixed through its rear wall with a non-return/check valve 9*a* that has a rubber/elastomeric, inlet port coupler 8*a* on the outside and venting inward to the unit. The non-return/check valve 9*a* is chosen for use with gas and liquid and of a low crack pressure operation so as to allow coolant liquid infusion manually at low pressures such as the hand squeezing pressure on a disposable plastic bottle of water. Through the exterior of the unit are also affixed venting from inward factory adjusted variable pressure, automatic release/purge valves 3*a*, 3*b*, 3*c*, 3*d*. The valves are set to the same release pressure which is to ensure the venting of the enclosure in the event of a failure of any of the valves where the others act as a backup safety valve. Also venting to the outside of the unit is affixed a bleed/relief/vent valve 4, which has a manually operated knob or handle used to depressurize the unit. This bleed/relief/vent valve 4, also has a tubular stem through which the coolant liquid may be drained if required to maintain a running coolant flow to the exterior such as to the sink/toilet of the aircraft.

To the exterior rear wall of the unit is affixed an agency/industry approved Halon and its derivatives based fire extinguisher 2*a*, that is coupled by means of one or more extinguisher quick release mounting retainer adapter clamps 5*d*, linked by the extinguisher quick release removable mounting fixture 5*b*, attached to the extinguisher static/fixed mounting fixture 5*a*. The inlet port coupler 8*a* is coupled by means of an inlet port coupling tube adaptor 8*b*, to the agency/industry approved Halon and its derivatives based fire extinguisher 2*a*. The possibility to enable the use of various agency/industry/carrier approved or preferred extinguisher cylinders is achieved by changing appropriate sets of the extinguisher quick release mounting retainer adapter clamps 5*d*, and the inlet port coupling tube adaptor 8*b* respectively that can be produced at low costs in different variations. Particularly, the in-suite mounting of the agency/industry approved Halon and its derivatives based fire extinguisher 2*a*, makes it possible to begin suppressive action on the fire rapidly during deployment, where the unique nature of the Lithium Ion battery/cell fire on board an aircraft in flight allows very low reaction/suppression times.

The factory adjusted variable pressure, automatic release/purge Valves 3*a*, 3*b*, 3*c*, 3*d*, are coupled with high temp resistant fume/smoke containment inflating bags/bellows 20, expanding bellows or light weight rolled-up air tight tubular bags either internally lined or made of high-temperature resistant/performance fabric or metallic foils to enable fume/vapor/smoke extraction and collection/containment during the operating phase and process of extinguishing the ensuing PED fire, the same being self-locking which could be, similar to a bloated/blown tubular balloon, there after dismounted/replaced once filled during the major fume releasing phase of the ensuing PED Fire to enable fume/vapor/smoke extraction and collection/containment during the operating phase and process of extinguishing the ensuing PED fire.

It is understood in optional embodiments of the unit, independently mounted, specially fabricated one or more, disposable or reusable, miniature, pre-filled, low dosage, one time, fully discharging type extinguishers/cartridges may be mounted in the interior or exterior of the unit and be operable triggered from within or external to the unit by either manual or automatic i.e., temperature or pressure sensor means. To rapidly dismount/remount a cylinder the extinguisher quick release band 5*c*, is so fabricated to be disengaged by a retaining lock. This feature also allows an unobstructed access to the inlet port coupler 8*a* for the manual coupling coolant liquid for example the mouth of a disposable plastic drinking water bottle or any other approved, independent fire extinguisher that is accessible on board the aircraft in flight.

Figure 4:
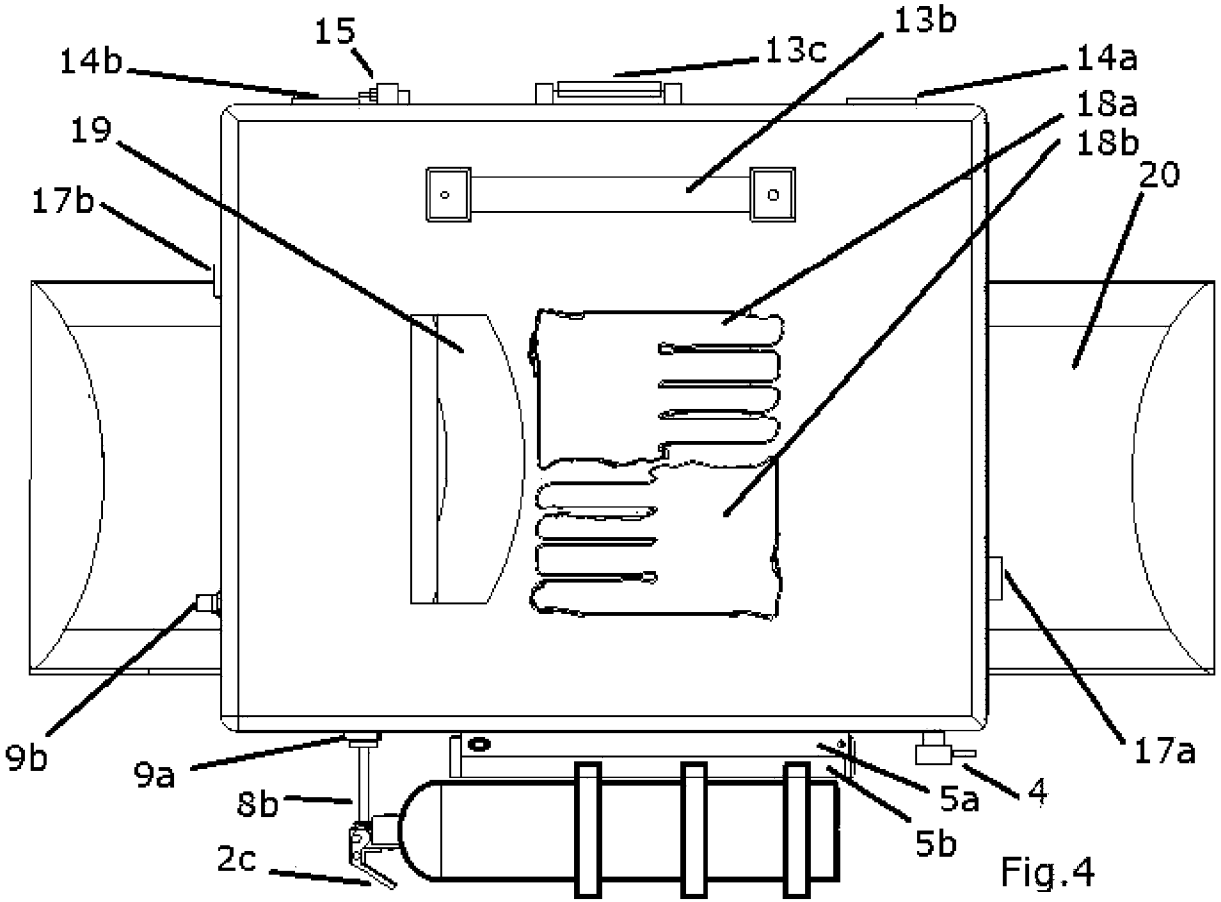
FIG. 4 shows a bottom view of the unit with inflated fume containment bags according to the invention.
Figure 5:
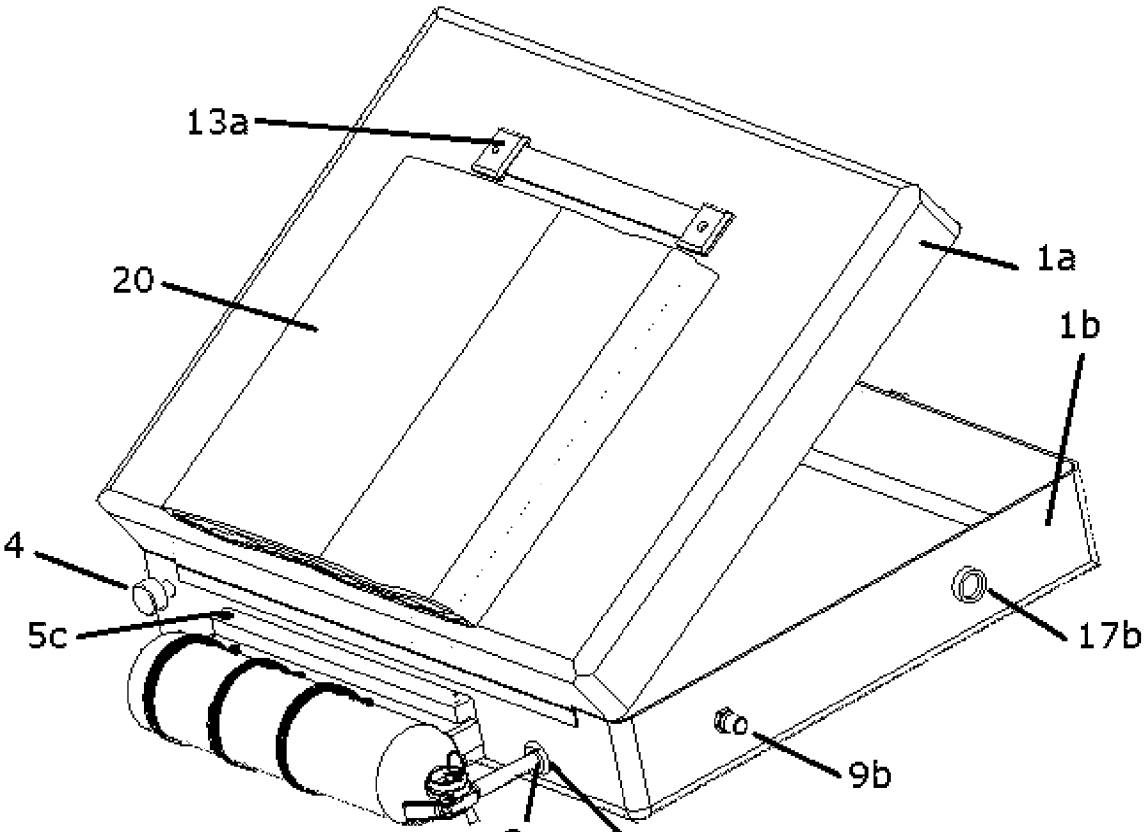
FIG. 5 shows a rear left hand side view of the unit during storage with folded & un-deployed fume containment bags according to the invention.

In the embodiment as shown in FIG. 1, a viewing port right Side 17*a*, and viewing port left side 17*b* are arranged to enable visual observance of the progress or decline of the encased fire and take prescribed action. A visual indication is provided by an optional pressure presence indicator, if the unit is under pressure internally due to the infusion of the pressurised extinguishing agent/gas and the desired resulting pressurized micro environment attained. When the unit is closed during its deployment both the top 1*b* and bottom 2*b* shells are retained shut by the locking clasp right side 14*a* and locking clasp left side 14*b* that are provided as shown in FIG. 4. In addition, a pressure safety interlock 15 is arranged in conjunction with the locking clasp left side 14*b* which prevents the accidental opening of the unit when it is in the internally pressurized state. In a different variation, the optional pressure presence indicator, could be combined with the pressure safety interlock 15 to achieve the working of both as a single unit and to enable cost/weight savings.

Figure 2:
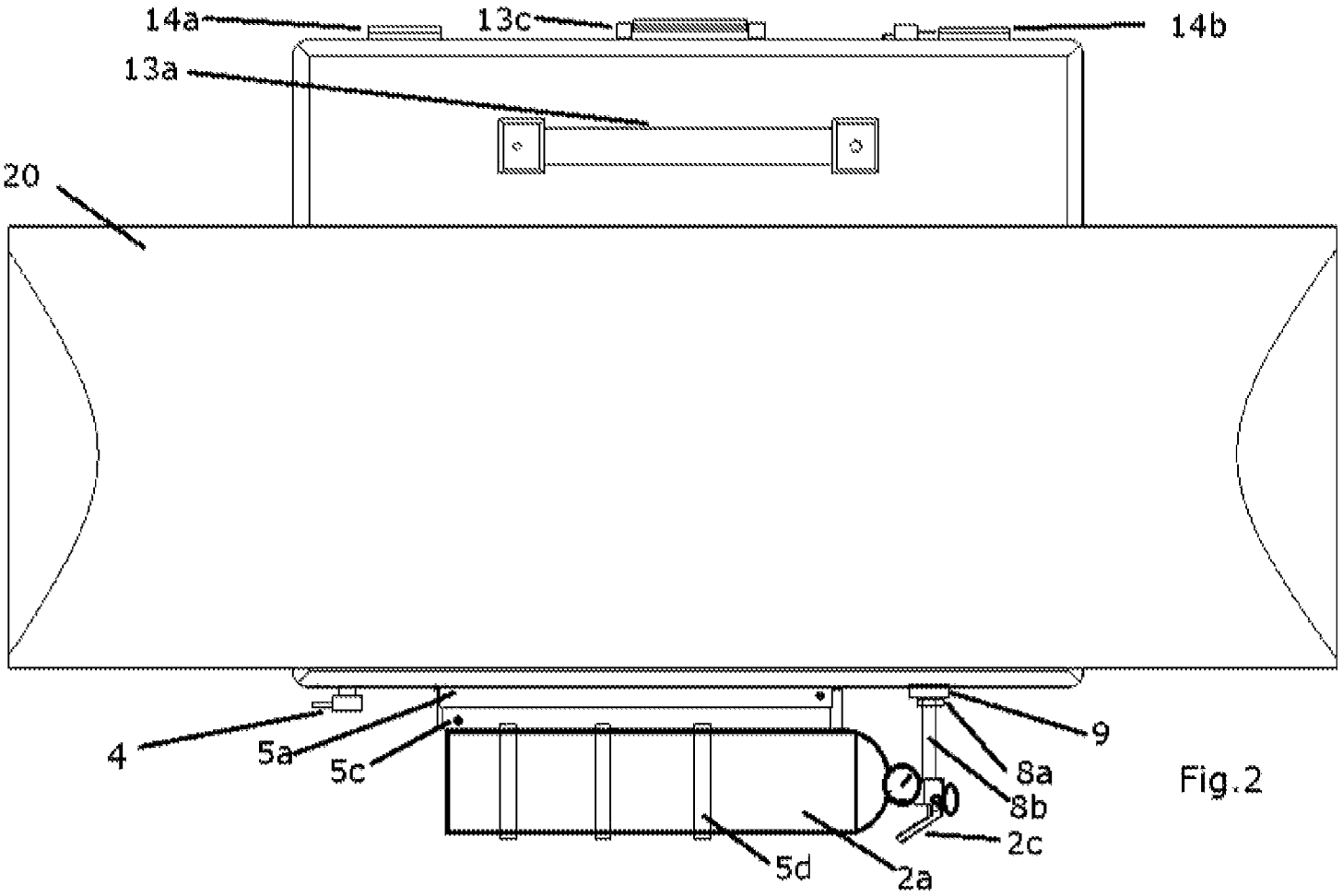
FIG. 2 shows a top/plan view of the unit with inflated fume containment bags according to the invention.
Figure 3:
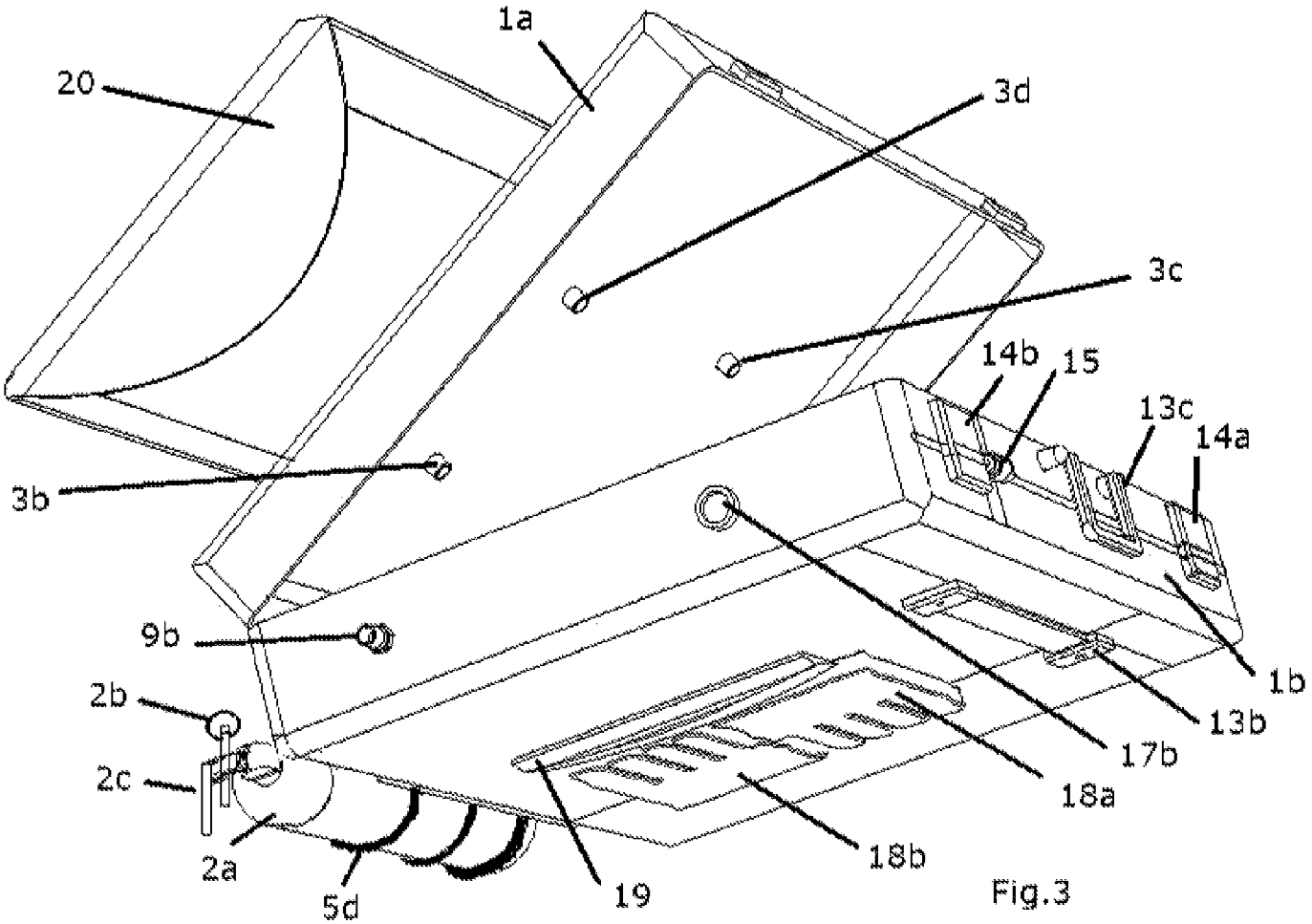
FIG. 3 shows a left hand side bottom view of the unit with inflated fume containment bags according to the invention.

As shown in FIG. 2, a pair of high-temperature fire proof right hand glove 18*a*, and high-temperature fire proof left hand glove 18*b* together with a face protection safety mask/glasses 19 are arranged and held in place by straps or buttons externally, visually noticeable on the top hinged shell of the light weight metal containment case 1 a, for rapid access and to be worn en-route through the aircraft spaces as the unit is being carried for deployment, thus saving reaction time.

The embodiment of the unit as shown in FIG. 1, FIG. 2, FIG. 3 and FIG. 4 and FIG. 5 is deployed and operated aboard an aircraft in flight upon the occurrence of a Lithium Ion battery/cell or PED fire as described in the following exemplary manner. The unit is retrieved from its prescribed storage aboard the aircraft by any of the handles 13*a*, 13*b* or 13*c*. It is thereafter held and manually carried in front by a person while at the same time pulling away the face protection safety mask/glasses 19 and wearing the same then sliding each hand in an alternating manner into the high temperature flame proof right hand glove 18*a* and high temperature flame proof left hand glove 18*b*. The gloves so provided would allow rapid wearing and also enable the easy operation/release of the locking clasp right Side 14*a* and locking clasp left side 14*b* thereafter allows the unit to be opened in a clam shell like manner. The unit is thus held open with the now exposed interior of the unit facing away from the person during deployment, by holding the pull handle band top 13*a*, and pull handle band bottom 13*b*, in the manner of a protective shield to approach the fire. It is understood that any USB or power jack that is a source of external applied power to the device on fire has by now been disconnected. Thereafter the unit is held over so as to encompass the battery/cell/PED on fire and then dragged/grabbed into the unit by a clam shell closing action of the top 1*b* and bottom 2*b* shells. Alternatively, the battery/cell/PED on fire may also be picked up manually and rapidly placed into the embodied unit if circumstances so allow. The unit after closure is then held closed by the locking clasp right side 14*a* and locking clasp left side 14*b*, and placed and held in place on a suitable surface such as the floor of the aircraft aisle/passageway or on an optionally supplied metallic mat, in the prescribed operative orientation of the attached agency/industry approved Halon and its derivatives based fire extinguisher 2*a*. Thereafter the commonly featured extinguisher safety lock Pin 2*b* is removed and the extinguisher release trigger handle 2*c* is operated in the prescribed manner as required by the respective agency/industry approved Halon and its derivatives based fire extinguisher 2*a* for a brief length of time to allow discharge and infusion of the approved extinguishing agent/gas into the unit.

The unit would now automatically vent outwards, into the high-temperature resistant fume/smoke containment inflating bags/bellows 20, the smoke/fumes generated by the encased battery/cell/PED on fire through any of the factory adjusted variable pressure, automatic release/purge valves 3*a*, 3*b*, 3*c*, 3*d* to accommodate the spatial volume of infusion and thereafter attain a now infused extinguishing agent/gas rich pressurized micro environment. The unit would now also be restrained from accidental opening by the automatic action of the pressure safety interlock 15 due to the pressurization. Any further continued infusion would be balanced by an automatically venting outward a proportional displaced volume as described previously. The progress of the fire may be observed through the viewing port right side 17*a*, and viewing port left side 17*b* and further infusions may be administered as required. The unit may also be additionally cooled if required by dispersing or applying coolant such as water on the exterior surface to extract the built up internal heat or by dismounting the agency/industry approved Halon and its derivatives based fire extinguisher 2*a*, by operating the extinguisher quick release band 5*c* and manually infusing through the now freely accessible inlet port coupler 8*a*, if required/prescribed any coolant such as water from a disposable plastic drinking water bottle. The infused volume of coolant is again automatically balanced by the unit functional components. In a different embodiment an optional additional and separate coolant inlet may be provided besides so as to infuse coolant without disengaging the fire extinguisher. To dissipate excess generated heat build-up, if required the infusions by supplement water bottles may be continuous as a running coolant through the unit to in which case the unit may be taken to the sink/toilet of the aircraft in flight where the bleed/relief/vent valve 4, may be kept open, till needed, to continuously drain the coolant outward through its tubular stem.

In the event that the progress of the fire requires additional infusion of extinguishing agent/gas over and above the in-suite attached/replacement cylinder than the same may be infused through the same inlet port through coupler 8*a* from any approved, independent fire extinguisher that is accessible on board the aircraft in flight. This extinguishing agent in conjunction with the gas rich pressurized and isolated micro environment would localize and exert the maximum and most efficient blanketing, thus suppressing/extinguishing the battery/cell/PED on fire as compared to its effect in the open on the same while also containing the battery/cell/PED on fire and its volatile effects/consequences on the surrounding during the course of its life. The resultant extinguishing of the battery/cell/PED fire and its stabilization due to the continued cooling effect of the case and/or coolant would prevent subsequent adjacent cell failures, in the case of a battery, and the re-occurrence of the well known unique thermal runaway phenomenon of the same, preventing the resultant re-ignition of the fire. The embodied unit as described may be kept infused with its extinguishing agent/gas rich pressurized micro environment with all its contents in an undisturbed state till the eventual completion of the aircraft flight. The unit may now be taken to a safe area where it may be depressurized or vented by opening the bleed/relief/vent valve 4, and releasing pressure safety interlock 15 and the locking clasp left side 14*b* which would allow the opening of the unit for retrieval of the partially damaged contents with a possibility to extract information or analyse for flight safety improvements.

The invention claimed is:

1. A Personal Electronic Device (PED) fire suppression apparatus for use in the aircraft cabin comprising:

A flight case with a plurality of hinged top and bottom shells configured to safely receive, contain and suppress a PED device, comprising PED material, on fire;

A fire extinguishing cylinder holding a supply of fire extinguishing medium therein, said fire extinguishing cylinder coupled to the exterior of said flight case by means of an easily removable clamping or fastening mechanism;

A plurality of inlet ports positioned on the exterior of said flight case, connected to the interior of said flight case and configured to receive said fire extinguishing medium;

A plurality of purge valves positioned on the exterior of said flight case, connected to the interior of said flight case and configured to expel fumes, gases or liquids from the interior of said flight case;

A plurality of flexible bags coupled to the exterior of said flight case, configured to contain said fumes, gases or liquids expelled from said purge valve while removing excess pressure from said flight case; and, wherein said fire extinguisher is coupled to said inlet port by means of a coupling mechanism for discharging said fire extinguishing medium into said flight case while simultaneously expelling said fumes, gases or liquids through said purge valves and containing said fumes, gases or liquids in said flexible bag such that the fire is suppressed while preventing further propagation in said PED material and maintaining a suppressive and isolating micro-environment in the interior of said flight case.

2. The PED fire suppression apparatus of claim 1, wherein the interior of said flight case is lined with a plurality of temperature and corrosion resistant layers.

3. The PED fire suppression apparatus of claim 1, wherein said fire extinguisher rapidly deploys said fire extinguishing medium and said PED is prevented from burning completely allowing for future retrieval of data.

4. The PED fire suppression apparatus of claim 2, wherein at least one layer is removable.

5. The PED fire suppression apparatus of claim 1, wherein a plurality of thermally activated stickers or layers of paint are positioned on the exterior of said flight case to provide visual cues corresponding to intensities of said PED device on fire.

6. The PED fire suppression apparatus of claim 1, wherein said flight case is a pre-existing, pre-fabricated, cost-effective unit.

7. The PED fire suppression apparatus of claim 1, wherein said flight case is configured to form a clam-shell unit for rapid deployment and ease of enveloping said PED on fire.

8. The PED fire suppression apparatus of claim 1, wherein said flexible bags are made of high-temperature and corrosion-resistant material to contain harsh/hot gases.

9. The PED fire suppression apparatus of claim 1, wherein said flight case further comprises a pressure safety interlock to prevent an accidental opening of said flight safety case when in use.

10. The PED fire suppression apparatus of claim 1, wherein said fire extinguishing medium is selected from a group of currently approved fire extinguishing media.

11. The PED fire suppression apparatus of claim 1, wherein said flight case comprises a plurality of viewing ports positioned on the exterior of said flight case and configured to observe said PED device on fire encased in the interior of said flight case.

12. The PED fire suppression apparatus of claim 1, further comprising a plurality of non-return valves positioned on the exterior of said flight case, connected to the interior of said flight case and configured to allow manual infusion of a liquid, coolant or gas into the interior of said flight case.

13. The PED fire suppression apparatus of claim 12, wherein said non-return valves possess a low crack pressure to allow manual squeezing of liquid into said flight case.

14. The PED fire suppression apparatus of claim 1, further comprising a vent valve positioned on the exterior of said flight case, connected to the interior of said flight case and configured to manually drain said liquid, coolant or gas from the interior of said flight case.

15. The PED fire suppression apparatus of claim 1, further comprising a plurality of protective gloves and at least one protective mask affixed on the exterior of said flight case by means of an easily removable fastening mechanism.

16. A method for suppressing PED fire in an aircraft cabin comprising:

Using a flight case with hinged top and bottom shells to receive a device on fire;

Coupling a fire extinguishing cylinder holding a supply of fire extinguishing medium therein, to the exterior of said flight case by means of a plurality of clamps easily removable clamping or fastening mechanism;

Providing a plurality of inlet ports positioned on the exterior of said flight case, connected to the interior of said flight case and configured to receive said fire extinguishing medium;

Providing a plurality of purge valves positioned on the exterior of said flight case, connected to the interior of said flight case and configured to expel fumes, gases or liquids from the interior of said flight case;

Providing a plurality of flexible bags positioned on the exterior of said flight case configured to contain said fumes, gases or liquids; and, wherein said PED fire is suppressed by coupling said fire extinguisher to said inlet ports by means of a coupling mechanism, discharging said fire extinguishing medium into said flight case while simultaneously expelling said fumes, gases or liquids through said purge valves while containing said fumes, gases or liquids in said flexible bags and creating a suppressive and isolating micro-environment while removing excess pressure from the interior of said flight case.

* * * * *